US009285703B2

(12) United States Patent
Abe

(10) Patent No.: US 9,285,703 B2
(45) Date of Patent: Mar. 15, 2016

(54) EXPOSURE DEVICE, IMAGE FORMING APPARATUS, AND METHOD OF CONTROLLING EXPOSURE DEVICE

(71) Applicant: BROTHER KOGYO KABUSHIKI KAISHA, Nagoya-shi, Aichi-ken (JP)

(72) Inventor: Naoki Abe, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/810,606

(22) Filed: Jul. 28, 2015

(65) Prior Publication Data

US 2016/0033891 A1 Feb. 4, 2016

(30) Foreign Application Priority Data

Jul. 31, 2014 (JP) ..... 2014-156743
Jun. 24, 2015 (JP) ..... 2015-126317

(51) Int. Cl.
*G03G 15/043* (2006.01)

(52) U.S. Cl.
CPC ..... *G03G 15/043* (2013.01)

(58) Field of Classification Search
None
See application file for complete search history.

(56) References Cited

U.S. PATENT DOCUMENTS

2011/0062994 A1 3/2011 Kusunoki
2012/0069127 A1* 3/2012 Murota ..... G03G 15/326 347/234

FOREIGN PATENT DOCUMENTS

JP 2007-90758 A 4/2007
JP 2011-61705 A 3/2011

* cited by examiner

*Primary Examiner* — Clayton E Laballe
*Assistant Examiner* — Jas Sanghera
(74) *Attorney, Agent, or Firm* — Merchant & Gould PC

(57) ABSTRACT

A plurality of light emitting elements is arranged in a main scanning direction. A setter is configured to set a basal exposure period of the plurality of light emitting elements, based on a clock count of frequency-spread clocks. A candidate generator is configured to add, to the basal exposure period, predetermined N alteration periods (N is an integer greater than or equal to two) having different lengths from each other, thereby generating N candidate exposure periods having different lengths from each other. A detector is configured to detect a frequency level of the clocks in a period corresponding to the basal exposure period. A selector is configured to select, as an exposure period for lighting the plurality of light emitting elements, a longer one of the N candidate exposure periods as the frequency level detected by the detector is higher.

19 Claims, 10 Drawing Sheets

EXPOSURE DEVICE, IMAGE FORMING APPARATUS, AND METHOD OF CONTROLLING EXPOSURE DEVICE

CROSS REFERENCE TO RELATED APPLICATIONS

This application claims priority from Japanese Patent Application No. 2014-156743 filed Jul. 31, 2014 and Japanese Patent Application No. 2015-126317 filed Jun. 24, 2015. The entire content of each of the priority applications is incorporated herein by reference.

TECHNICAL FIELD

The disclosure relates to an exposure device, an image forming apparatus, and a method of controlling an exposure device.

BACKGROUND

As one of countermeasures for EMI (Electro Magnetic Interference), there has conventionally been known an image forming apparatus in which an exposure period of its exposure unit is set based on the clock count of a spread spectrum clock with varying frequency. In such an image forming apparatus, however, the length of the exposure period may vary due to variations in the frequency of the spread spectrum clock. Accordingly, there has been known a technique that an integral value of a periodic function showing frequency variations of the spread spectrum clock is calculated by an integration processing unit and then the exposure period set based on the clock count of the spread spectrum clock is corrected by using the calculated integral value.

SUMMARY

According to one aspect, this specification discloses an exposure device. The exposure device includes a plurality of light emitting elements, a setter, a candidate generator, a detector, and a selector. The plurality of light emitting elements is arranged in a main scanning direction. The setter is configured to set a basal exposure period of the plurality of light emitting elements, based on a clock count of frequency-spread clocks. The candidate generator is configured to add, to the basal exposure period, predetermined N alteration periods (N is an integer greater than or equal to two) having different lengths from each other, thereby generating N candidate exposure periods having different lengths from each other. The detector is configured to detect a frequency level of the clocks in a period corresponding to the basal exposure period. The selector is configured to select, as an exposure period for lighting the plurality of light emitting elements, a longer one of the N candidate exposure periods as the frequency level detected by the detector is higher.

According to another aspect, this specification also discloses an image forming apparatus. The image forming apparatus includes a photosensitive member, a plurality of light emitting elements, a setter, a candidate generator, a detector, and a selector. The plurality of light emitting elements is arranged in a rotational axis direction of the photosensitive member. The setter is configured to set a basal exposure period of the plurality of light emitting elements, based on a clock count of frequency-spread clocks. The candidate generator is configured to add, to the basal exposure period, predetermined N alteration periods (N is an integer greater than or equal to two) having different lengths from each other, thereby generating N candidate exposure periods having different lengths from each other. The detector is configured to detect a frequency level of the clocks in a period corresponding to the basal exposure period. The selector is configured to select a longer one of the N candidate exposure periods as the frequency level detected by the detector is higher. The plurality of light emitting elements is configured to expose the photosensitive member during the candidate exposure period.

According to still another aspect, this specification also discloses a method of controlling an exposure device including a plurality of light emitting elements arranged in a main scanning direction. The method includes: setting a basal exposure period of the plurality of light emitting elements, based on a clock count of frequency-spread clocks; adding, to the basal exposure period, predetermined N alteration periods (N is an integer greater than or equal to two) having different lengths from each other, thereby generating N candidate exposure periods having different lengths from each other; detecting a frequency level of the clocks in a period corresponding to the basal exposure period; and selecting, as an exposure period for lighting the plurality of light emitting elements, a longer one of the N candidate exposure periods as the frequency level is higher.

The technology disclosed in this specification can be realized in various modes. For example, the technology can be realized in modes of an exposure device, an image forming apparatus, a method of controlling an exposure device, a computer program for realizing functions of such device or method, a non-transitory storage medium storing such computer program, and so on.

BRIEF DESCRIPTION OF THE DRAWINGS

Embodiments in accordance with the disclosure will be described in detail with reference to the following figures wherein.

DETAILED DESCRIPTION

With the above-described technology, however, integration processing for integrating the periodic function is involved to correct the length of the exposure period. This causes a problem, for example, that processing involved until the exposure period is corrected is complicated. Thus, there is a desire for a technique which makes it possible to suppress variations of the exposure period while utilizing a frequency-spread clock such as a spread spectrum clock without performing such complex processing as the integration processing.

Figure 1:
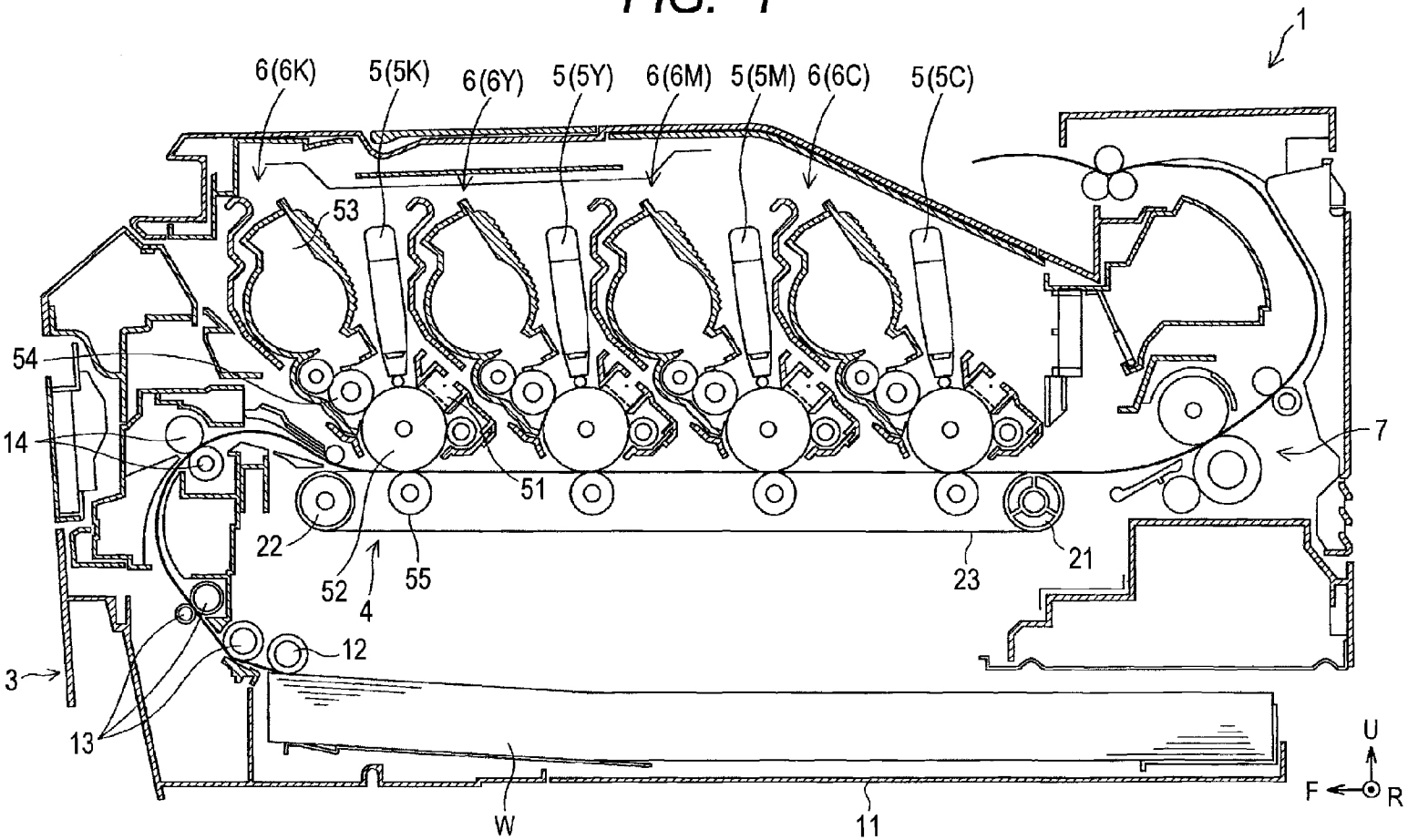
FIG. 1 is a schematic view showing a mechanical configuration of a printer 1.
Figure 2:
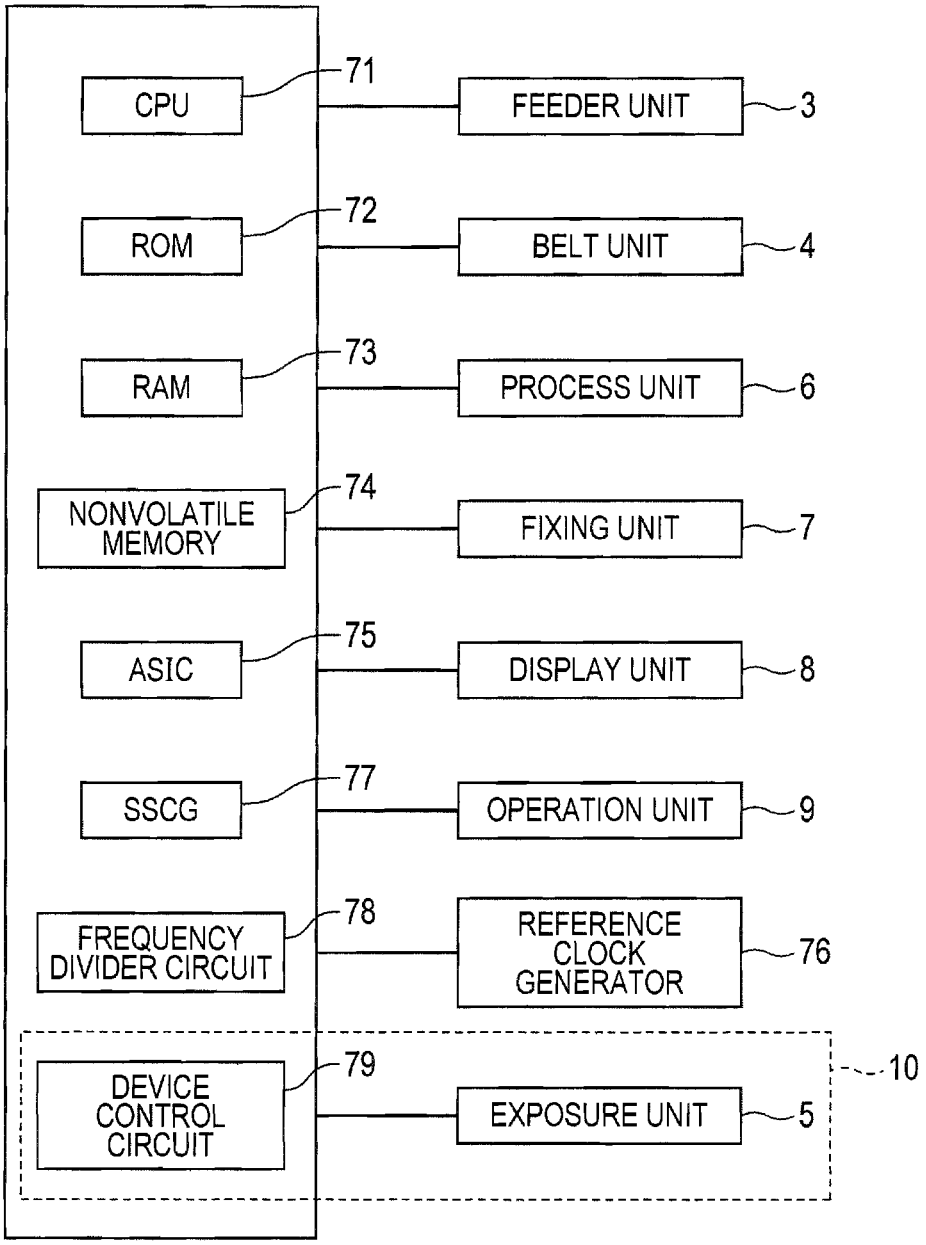
FIG. 2 is a block diagram showing an electrical configuration of the printer 1.

A printer 1 according to one aspect will be described below with reference to FIGS. 1 to 8. In the following description, the left side of the drawing sheet of FIG. 1 is assumed as a front side F of the printer 1, the viewer-facing side of the sheet is assumed as a right side R of the printer 1, and the upper side of the sheet is assumed as an upper side U of the printer 1. The printer 1 is a direct-transfer tandem type color laser printer capable of forming color images by using, for example, toners in four colors of black, yellow, magenta and cyan, the printer being an example of the image forming apparatus. In the following description, K (black), Y (yellow), M (magenta) or C (cyan) meaning the colors, respectively, are added to tail ends of reference signs of component parts of the printer 1 or the like in order to make color-by-color distinctions among those individual component parts and terms; otherwise, such addition may be omitted as appropriate. In FIG. 1, as appropriate, signs are omitted for the component parts that are identical among the individual colors.

The printer 1 includes a feeder unit 3, a belt unit 4, four exposure units 5 (5K, 5Y, 5M, 5C), four process units 6 (6K, 6Y, 6M, 6C), and a fixing unit 7.

The feeder unit 3, which is provided at the lowermost portion of the printer 1, has a tray 11 capable of storing a plurality of sheets W, a pickup roller 12, conveyance rollers 13, and registration rollers 14. The pickup roller 12 picks up the sheets W stored on the tray 11 one by one, and the conveyance rollers 13 and the registration rollers 14 convey the sheet W picked up by the pickup roller 12 to the belt unit 4.

The belt unit 4 includes a driving roller 21, a follow roller 22 and a belt 23. The belt 23 is stretched over between the driving roller 21 and the follow roller 22. As the driving roller 21 is rotated, a one-side surface of the belt 23 facing the process units 6 is moved backward so that the sheet W delivered from the registration rollers 14 is conveyed by the surface from the process units 6 to the fixing unit 7.

Combinations of an exposure unit 5 and a process unit 6 each corresponding to an identical-color toner are arrayed along a front-and-rear direction, i.e., the conveyance direction of the sheet W by the belt 23. Hereinafter, on the assumption that the four combinations of an exposure unit 5 and a process unit 6 are similar in configuration except the toner color, the specific configuration will be described on an exemplary case of the exposure unit 5K and the process unit 6K corresponding to black.

Figure 3:
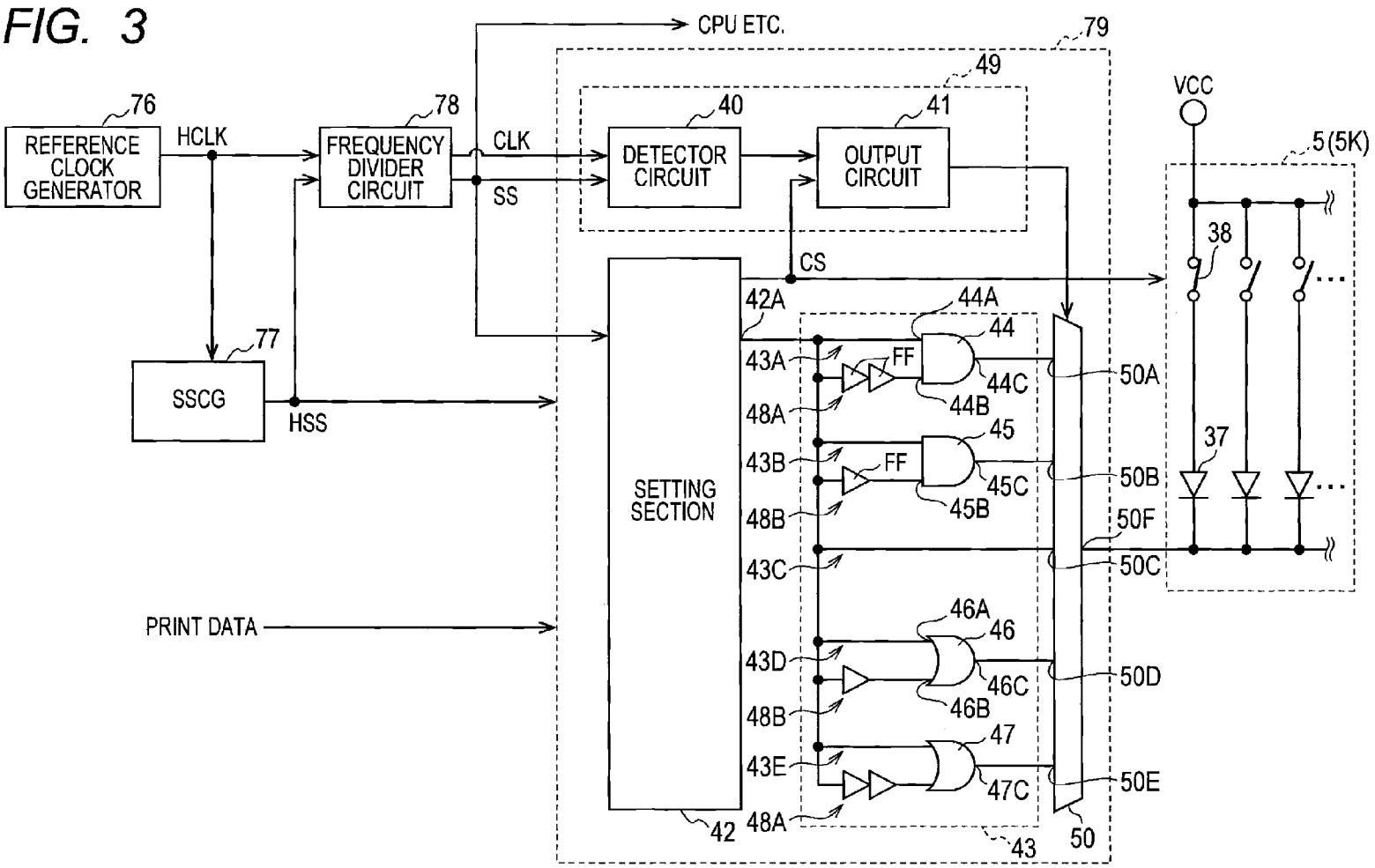
FIG. 3 is a circuit diagram around a device control circuit 79 and an exposure unit 5.

As shown in FIG. 3, the exposure unit 5K includes a plurality of LED elements 37 arrayed in a left-and-right direction, i.e., a main scanning direction parallel to the rotational-axis direction of a later-described photosensitive drum 52. The individual LED elements 37 are connected in series to individual switching elements 38, respectively, and moreover connected in parallel to one another between a power source voltage VCC and an output terminal 50F of a later-described selector section 50. The exposure unit 5K sequentially switches an LED element 37 of the lighting target (an LED element 37 to emit light) in the main scanning direction by the switching elements 38 to expose the photosensitive drum 52. As a result, the exposure unit 5K forms an electrostatic latent image on the surface of the photosensitive drum 52.

The process unit 6K includes a charging unit 51, the photosensitive drum 52, a toner box 53, a developing roller 54, and a transfer roller 55. The photosensitive drum 52 is an example of the photosensitive member.

The charging unit 51 uniformly charges the surface of the photosensitive drum 52. The developing roller 54 feeds the toner contained in the toner box 53 onto the photosensitive drum 52 to develop the electrostatic latent image formed by the exposure unit 5K, thus forming a toner image on the photosensitive drum 52. The transfer roller 55, which is placed so as to face the photosensitive drum 52 via the belt 23, transfers the toner image formed on the photosensitive drum 52 to the sheets W.

The sheet W, to which toner images of individual colors have been transferred, is conveyed to the fixing unit 7 by the belt unit 4. After the toner images are thermally fixed at the fixing unit 7, the sheet W is discharged onto the top surface of the printer 1.

In addition to the feeder unit 3, the belt unit 4, the exposure units 5, the process units 6 and the fixing unit 7 as described above, as shown in FIG. 2, the printer 1 further includes a central processing unit (hereinafter, referred to as CPU) 71, a ROM 72, a RAM 73, a nonvolatile memory 74, an ASIC (Application Specific Integrated Circuit) 75, a display unit 8, an operation unit 9, a reference clock generator 76, a spread spectrum clock generator (hereinafter, referred to as SSCG) 77, a frequency divider circuit 78, and a device control circuit 79. As shown by broken line 10, a unit containing the device control circuit 79 and the exposure unit 5 is an example of the exposure device.

The ROM 72 stores various types of programs for controlling operations of individual sections of the printer 1. The RAM 73 and the nonvolatile memory 74 are used as a working area for the CPU 71 to execute various types of programs or as a temporary storage area for print data. The nonvolatile memory 74 may be a rewritable memory such as NVRAM, flash memory, HDD, EEPROM or the like.

The CPU 71 controls individual sections of the printer 1 according to programs read from the ROM 72. The ASIC 75 is a hardware circuit to be used exclusively for image processing as an example. The display unit 8, having a liquid crystal display, displays various types of setting screens, device operation statuses and the like. The operation unit 9, having a plurality of buttons, receives various input commands by a user.

As shown in FIG. 3, the reference clock generator 76 generates a high-frequency clock HCLK having a constant frequency of about 1 GHz and transmits the clock to the SSCG 77 and the frequency divider circuit 78. The SSCG 77 makes the high-frequency clock HCLK spread in frequency to generate a high-frequency spread spectrum clock HSS having its frequency varied at a constant frequency. The SSCG 77 transmits the generated high-frequency spread spectrum clock HSS to the frequency divider circuit 78 and the device control circuit 79.

The frequency divider circuit 78 divides the high-frequency clock HCLK to generate a reference clock CLK, and transmits the clock to the device control circuit 79. The frequency divider circuit 78 also divides the high-frequency spread spectrum clock HSS to generate a spread spectrum clock SS (see FIG. 8), and transmits the clock to such individual sections as the CPU 71 and the device control circuit 79. The spread spectrum clock SS is an example of the frequency-spread clock.

In the individual sections to which the spread spectrum clock SS is transmitted, their operation is controlled by the spread spectrum clock SS so that EMI generation is suppressed as compared with cases in which the operation is controlled by the reference clock CLK. Meanwhile, if emission time of each LED element 37 included in the exposure units 5, i.e., exposure period RB is set based on the clock count of the spread spectrum clock SS, it results that the length of the exposure period RB is varied due to variations of the frequency of the spread spectrum clock SS.

The device control circuit 79 suppresses the variations of the exposure period RB while using the spread spectrum clock SS. For this purpose, the device control circuit 79 includes a setting section 42, a candidate generator section 43, a detector section 49, and a selector section 50.

Figure 8:
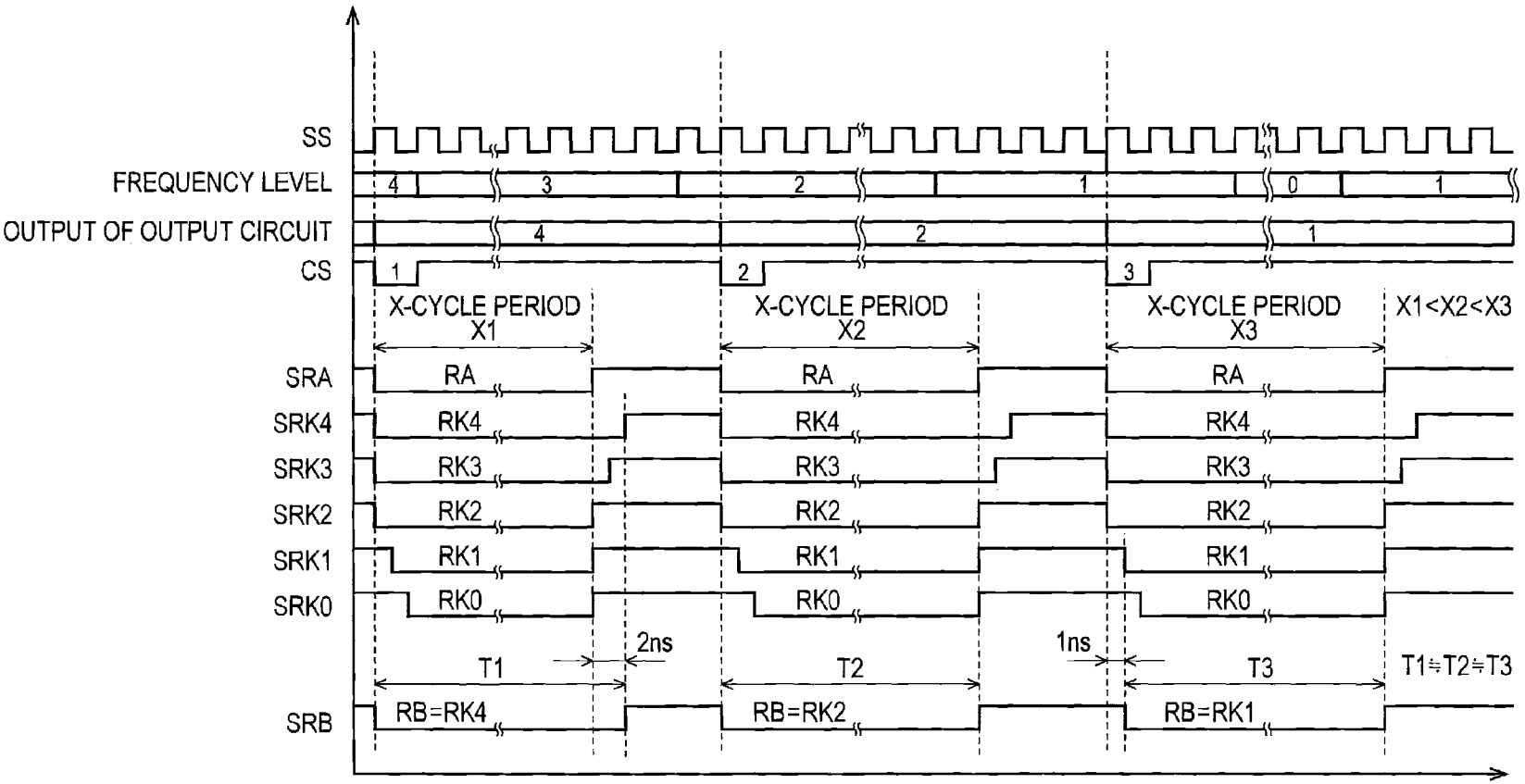
FIG. 8 is a timing chart of the basal exposure signal SRA and an exposure signal SRB.

The setting section 42 generates a switching signal CS for switching the LED element 37 of the lighting target in the exposure units 5 and transmits the signal to the exposure units 5 and the detector section 49. As shown in FIG. 8, the switching signal CS becomes L level (trailing edge) every specified clock count of the spread spectrum clock SS. In the exposure unit 5, the switching elements 38 is switched over at the timing when the switching signal CS becomes L level, by which an LED element 37 of the lighting target is selected from among the plurality of LED elements 37.

The setting section 42 also sets a basal exposure period RA of the LED element 37 of the exposure unit 5 based on the clock count of the spread spectrum clock SS. It is noted here that the basal exposure period RA is an exposure period that serves as a basis for setting the exposure period RB. More specifically, upon acquisition of print data from the RAM 73 or the nonvolatile memory 74 due to an input operation to the operation unit 9 by a user or the like, the setting section 42 converts tone values of the print data corresponding to the LED element 37 of the lighting target into clock counts of the spread spectrum clock SS. As shown in FIG. 8, the setting section 42 sets the basal exposure period RA that lasts from the timing when the switching signal CS becomes L level for a length corresponding to cycles of the clock count (X in FIG. 8) of the spread spectrum clock SS. The setting section 42 outputs, from its output terminal 42A to the candidate generator section 43, a basal exposure signal SRA which becomes L level at a start timing of the basal exposure period RA and which becomes H level at an end timing of the basal exposure period RA. The basal exposure signal SRA is an example of the input signal. The RAM 73 and the nonvolatile memory 74 are an example of the memory.

The candidate generator section 43 adds five predetermined alteration periods HTs to the basal exposure period RA to thereby generate five candidate exposure periods RKs from the basal exposure period RA. The lengths of the five alteration periods HTs are different from one another. The lengths of the five candidate exposure periods RKs are different from one another. More specifically, the candidate generator section 43 includes five candidate generator circuits 43A to 43E for generating five candidate exposure periods RK0 to RK4 from the basal exposure period RA. The lengths of the five candidate exposure periods RK0 to RK4 are different from one another. The five alteration periods HT0 to HT4 include positive alteration period HT, negative alteration period HT, and alteration period of zero (0).

The candidate generator circuit 43A includes an AND circuit 44 and a delay circuit 48A. One input terminal 44A of the AND circuit 44 is connected to the output terminal 42A of the setting section 42 and receives the basal exposure signal SRA as an input. On the other hand, the other input terminal 44B of the AND circuit 44 is connected to the output terminal 42A of the setting section 42 via the delay circuit 48A.

Figure 4:
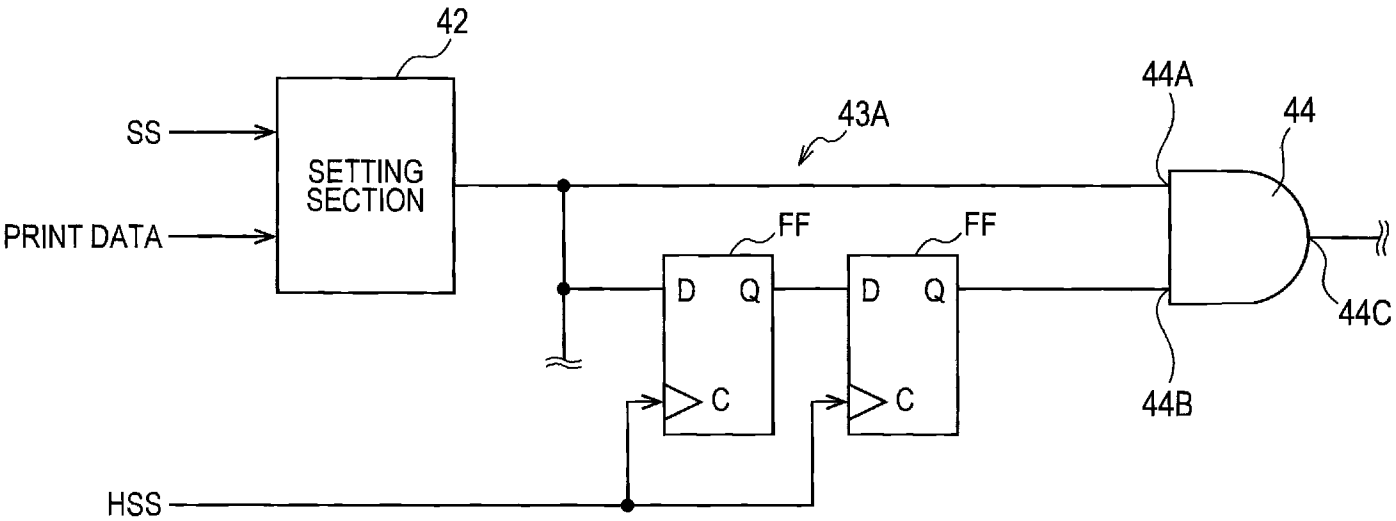
FIG. 4 is a circuit diagram around a candidate generator circuit 43A.
Figure 7:
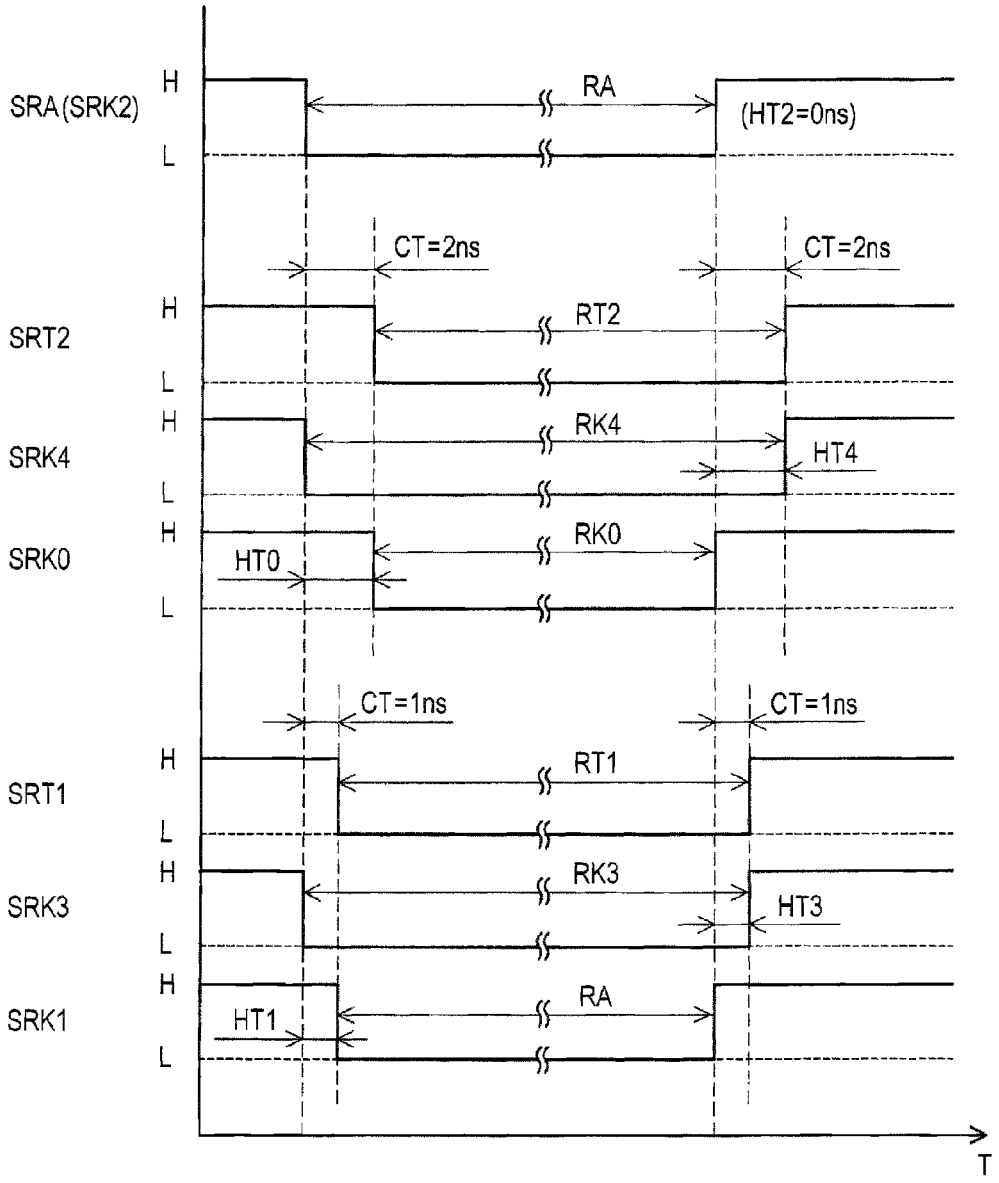
FIG. 7 is a timing chart of a basal exposure signal SRA, delay signals SRT2, SRT1 and candidate exposure signals SRK0 to SRK4.

The delay circuit 48A includes two delay elements FF. More specifically, as shown in FIG. 4, two flip-flop circuits FF are connected in series to the delay circuit 48A. Each delay element FF delays the basal exposure signal SRA by a specified delay period during the transmission of the basal exposure signal SRA from D terminal to Q terminal. The high-frequency spread spectrum clock HSS is inputted to C terminal of each flip-flop circuit FF. Therefore, the specified delay period is a period shorter than the shortest clock cycle of the spread spectrum clock SS, specifically approximately 1 ns. That is, the delay period CT of the delay circuit 48A is approximately 2 ns. As a result, as shown in FIG. 7, a delay signal SRT2, which becomes L level at a start timing of a delay exposure period RT2 resulting from delaying the basal exposure period RA by approximately 2 ns and which becomes H level at an end timing of the delay exposure period RT2, is inputted to the other input terminal 44B of the AND circuit 44.

As a result of this, a candidate exposure signal SRK4 indicative of a candidate exposure period RK4 is outputted from an output terminal 44C of the AND circuit 44. The start timing of the candidate exposure period RK4 is maintained at the start timing of the basal exposure period RA. On the other hand, the end timing of the candidate exposure period RK4 is changed to the end timing of the delay exposure period RT2 that is delayed from the end timing of the basal exposure period RA by approximately 2 ns. That is, the candidate generator circuit 43A generates a candidate exposure period RK4 which is prolonged from the basal exposure period RA by approximately 2 ns relative to the basal exposure period RA, i.e., to which a positive alteration period HT4 of approximately 2 ns is added. The candidate generator circuit 43A outputs the candidate exposure signal SRK4 indicative of the candidate exposure period RK4 to an input terminal 50A of the selector section 50.

As shown in FIG. 3, the candidate generator circuit 43B is a circuit in which the delay circuit 48A of the candidate generator circuit 43A is replaced with a delay circuit 48B. The delay circuit 48B differs from the delay circuit 48A in that the number of included delay element FF is one. Therefore, the delay period CT of the delay circuit 48B is approximately 1 ns. As shown in FIG. 7, a delay signal SRT1, which becomes L level at a start timing of a delay exposure period RT1 resulting from delaying the basal exposure period RA by approximately 1 ns and which becomes H level at an end timing of the delay exposure period RT1, is inputted to the other input terminal 45B of the AND circuit 45.

As a result of this, a candidate exposure signal SRK3 indicative of a candidate exposure period RK3 is outputted from an output terminal 45C of the AND circuit 45. The start timing of the candidate exposure period RK3 is maintained at the start timing of the basal exposure period RA. On the other hand, the end timing of the candidate exposure period RK3 is changed to the end timing of the delay exposure period RT1 that is delayed from the end timing of the basal exposure period RA by approximately 1 ns. That is, the candidate generator circuit 43B generates a candidate exposure period RK3 which is prolonged from the basal exposure period RA by approximately 1 ns relative to the basal exposure period RA, i.e., to which a positive alteration period HT3 of approximately 1 ns is added. The candidate generator circuit 43B outputs the candidate exposure signal SRK3 indicative of the candidate exposure period RK3 to an input terminal 50B of the selector section 50.

The candidate generator circuit 43C is a circuit for connecting the output terminal 42A of the setting section 42 and an input terminal 50C of the selector section 50 by a wiring pattern. The candidate generator circuit 43C outputs the basal exposure signal SRA as a candidate exposure signal SRK2 indicative of a candidate exposure period RK2 indicative of the candidate exposure period RK2 to the input terminal 50C of the selector section 50. That is, the alteration period HT2 of the candidate generator circuit 43C is an alteration period of zero.

The candidate generator circuit 43D includes an OR circuit 46 and a delay circuit 48B. One input terminal 46A of the OR circuit 46 is connected to the output terminal 42A of the setting section 42 and receives the basal exposure signal SRA as an input. On the other hand, the other input terminal 46B of the OR circuit 46 is connected to the output terminal 42A of the setting section 42 via the delay circuit 48B.

As a result of this, a candidate exposure signal SRK1 indicative of a candidate exposure period RK1 is outputted from an output terminal 46C of the OR circuit 46. The start timing of the candidate exposure period RK1 is changed to the start timing of the delay exposure period RT1 that is delayed from the start timing of the basal exposure period RA by approximately 1 ns. On the other hand, the end timing of the candidate exposure period RK1 is maintained at the end timing of the basal exposure period RA. That is, the candidate generator circuit 43D generates a candidate exposure period RK1 which is shortened from the basal exposure period RA by approximately 1 ns relative to the basal exposure period RA, i.e., to which a negative alteration period HT1 of approximately 1 ns is added. The candidate generator circuit 43D outputs the candidate exposure signal SRK1 indicative of the candidate exposure period RK1 to an input terminal 50D of the selector section 50.

The candidate generator circuit 43E is a circuit in which the delay circuit 48B of the candidate generator circuit 43D is replaced with the delay circuit 48A. A candidate exposure signal SRK0 indicative of a candidate exposure period RK0 is outputted from an output terminal 47C of an OR circuit 47. The start timing of the candidate exposure period RK0 is changed to the start timing of the delay exposure period RT2 that is delayed from the start timing of the basal exposure period RA by approximately 2 ns. On the other hand, the end timing of the candidate exposure period RK0 is maintained at the end timing of the basal exposure period RA. That is, the candidate generator circuit 43E generates a candidate exposure period RK0 which is shortened from the basal exposure period RA by approximately 2 ns relative to the basal exposure period RA, i.e., to which a negative alteration period HT0 of approximately 2 ns is added. The candidate generator circuit 43E outputs the candidate exposure signal SRK0 indicative of the candidate exposure period RK0 to an input terminal 50E of the selector section 50.

The detector section 49 detects a frequency level of the spread spectrum clock SS at the timing when the switching signal CS becomes L level, i.e., a start timing of the basal exposure period RA. It is noted here that the term "frequency level" refers to frequency ranges of the spread spectrum clock SS, i.e., frequency value ranges or frequency bands; those frequency levels are defined as described below and set in the detector section 49.

Figure 5:
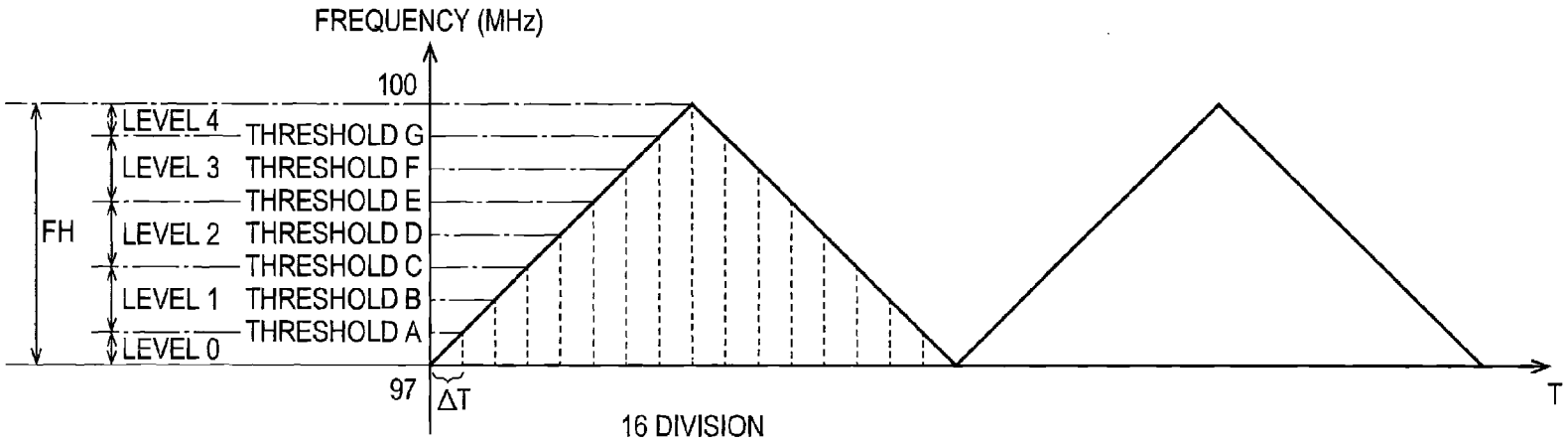
FIG. 5 is a timing chart showing frequency variations of a spread spectrum clock SS.

As shown in FIG. 5, the frequency of the spread spectrum clock SS varies at a variation cycle of 50 KHz in a triangular-wave shape within a fixed frequency region FH of 97 MHz to 100 MHz. Dividing the modulation cycle of the spread spectrum clock SS by 16 yields definition of seven thresholds A to G by which the frequency region is eight-divided. In the detector section 49, five frequency levels are set including Level 0 in which the frequency is less than threshold A, Level 1 in which the frequency is equal to or higher than threshold A and lower than threshold C, Level 2 in which the frequency is equal to or higher than threshold C and lower than threshold E, Level 3 in which the frequency is equal to or higher than threshold E and lower than threshold G, and Level 4 in which the frequency is equal to or higher than threshold G.

Figure 6:
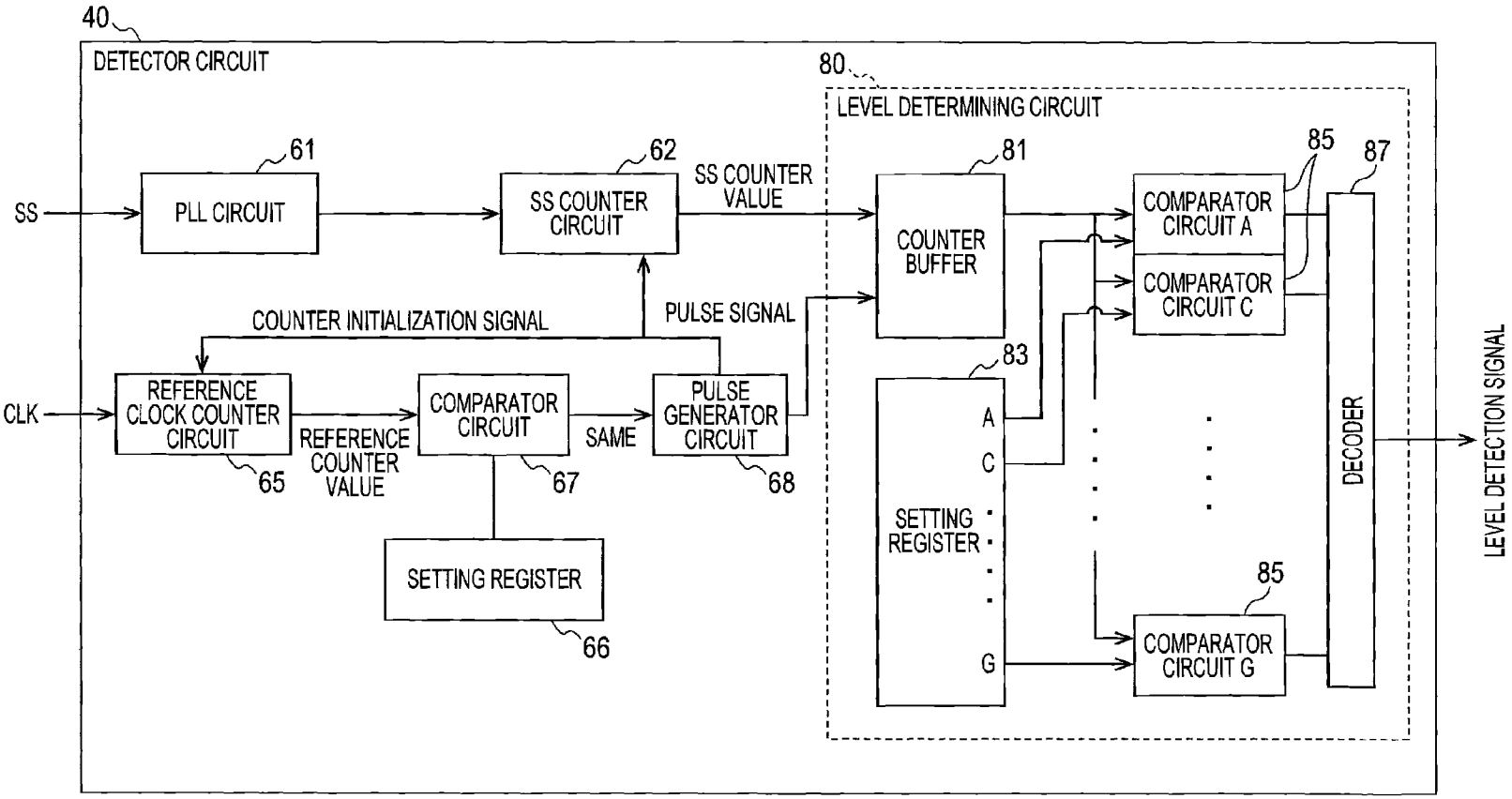
FIG. 6 is a circuit diagram of a detector circuit 40.

The detector section 49 detects a frequency level of the spread spectrum clock SS by using the set frequency levels. More specifically, as shown in FIG. 3, the detector section 49 includes a detector circuit 40 and an output circuit 41. As shown in FIG. 6, the detector circuit 40 includes a PLL circuit 61, an SS counter circuit 62, a reference clock counter circuit 65, a setting register 66, a comparator circuit 67, a pulse generator circuit 68, and a level determining circuit 80. The SS counter circuit 62 is an example of the counter circuit.

The PLL circuit 61 multiplies a frequency of the spread spectrum clock SS inputted from the frequency divider circuit 78. The SS counter circuit 62 counts the SS counter value that is the clock count of the spread spectrum clock SS inputted from the PLL circuit 61. The reference clock counter circuit 65 counts the reference counter value that is the clock count of the reference clock CLK inputted from the frequency divider circuit 78. The comparator circuit 67 compares a reference counter value counted by the reference clock counter circuit 65 with a certain first reference clock count stored in the setting register 66. If a comparison result by the comparator circuit 67 is the same, then the pulse generator circuit 68 outputs a pulse signal indicative of the same to the level determining circuit 80. When the comparison result by the comparator circuit 67 is the same, the pulse generator circuit 68 outputs a counter initialization signal to the SS counter circuit 62 and the reference clock counter circuit 65.

In more detail, the pulse generator circuit 68 outputs a pulse signal and a counter initialization signal at every regular period corresponding to the first reference clock count. The constant period corresponding to the first reference clock count is set so as to be equal to a divided time ΔT resulting from 16-division of the modulation cycle of the spread spectrum clock SS. Therefore, the pulse generator circuit 68 outputs the pulse signal and the counter initialization signal at every time period corresponding to the divided time ΔT. The constant period corresponding to the first reference clock count is an example of the particular period and the certain period.

The reference clock counter circuit 65, upon input of the counter initialization signal from the pulse generator circuit 68, initializes the reference counter value. The SS counter circuit 62, upon input of the counter initialization signal from the pulse generator circuit 68, outputs an SS counter value to the level determining circuit 80, thereafter initializing the SS counter value. That is, the SS counter circuit 62 counts the clock number of the spread spectrum clock SS at the divided time ΔT and outputs the counting result to the level determining circuit 80.

From the SS counter value counted by the SS counter circuit 62, the level determining circuit 80 decides a frequency level of the spread spectrum clock SS at the divided time ΔT. The level determining circuit 80 includes a counter buffer 81, a setting register 83, four comparator circuits 85, and a decoder 87. The counter buffer 81 holds an SS counter value inputted from the SS counter circuit 62 in synchronization with the pulse signal inputted from the pulse generator circuit 68.

Four thresholds A, C, E, G for classification into five frequency levels are stored in the setting register 83. The four thresholds A, C, E, G are set in correspondence to the four comparator circuits 85, respectively, and the comparator circuits 85 compare the SS counter value held in the counter buffer 81 with the corresponding thresholds A, C, E, G, respectively. From the comparison results by the individual comparator circuits 85, the decoder 87 detects a frequency level of the spread spectrum clock SS at the divided time ΔT at which the SS counter value is counted, and then outputs a level detection signal indicative of the detected frequency level to the output circuit 41.

The output circuit 41 outputs a detection result of the detector circuit 40 to the selector section 50. More specifically, as shown in FIG. 8, the output circuit 41 acquires a frequency level of the level detection signal received from the detector circuit 40 at the timing when the switching signal CS becomes L level, and holds the acquired frequency level until the timing when the switching signal CS next becomes L level. That is, the output circuit 41 holds the frequency level while the LED element 37 of the lighting target is emitting light. The output circuit 41 outputs a level detection signal indicative of the held frequency level to the selector section 50.

As the frequency level detected by the detector section 49 is higher (that is, at a higher frequency side), the selector section 50 selects a longer candidate exposure period out of the five candidate exposure periods RK0 to RK4, as an exposure period RB applied for lighting the LED element 37 of the lighting target. More specifically, when the frequency level detected by the detector section 49 is Level M (M=0 to 4), the selector section 50 selects the candidate exposure period RKM as the exposure period RB.

The selector section 50 is a selector circuit, and five frequency levels are associated with the five input terminals 50A to 50E, respectively. From a frequency level indicated by the level detection signal outputted from the output circuit 41, the selector section 50 connects one of the five input terminals 50A to 50E to the output terminal 50F. As a result, an exposure signal SRB indicative of the exposure period RB is outputted to the exposure unit 5.

The five frequency levels are associated with five candidate generator circuits 43A to 43E by the five input terminals 50A to 50E, respectively. As the frequency level detected by the detector section 49 is higher, the selector section 50 is associated with one of the candidate generator circuits 43A to 43E that generates a longer alteration period HT. The alteration period HT is longer in the order of negative alteration periods, an alteration period of zero, and positive alteration periods. The negative alteration period becomes longer as the absolute value decreases. The positive alteration period becomes longer as the absolute value increases. Therefore, the number of delay elements FF included in the delay circuits 48A, 48B of the corresponding candidate generator circuits 43A to 43E differs depending on the frequency level.

When one of the five input terminals 50A to 50E is connected to the output terminal 50F by the selector section 50, a candidate exposure signal SRK0 to SRK4 corresponding to the one of the candidate exposure periods RK0 to RK4 inputted to the connected input terminals 50A to 50E is outputted to the output terminal 50F. As a result of this, the LED element 37 of the lighting target emits light during the period in which the relevant candidate exposure signal keeps at L level. That is, the LED element 37 of the lighting target emits light during the candidate exposure period RK0 to RK4 inputted to the connected input terminal 50A to 50E.

As described above, according to the printer 1 of this embodiment, a basal exposure period RA is set from the clock count of the spread spectrum clock SS. In this case, even with the basal exposure period RA set equally to an X-cycle period as shown in FIG. 8, the actual lengths X1 to X3 of the basal exposure period RA differ from one another depending on the frequency level of the spread spectrum clock SS at the timing when the switching signal CS becomes L level.

In the printer 1 of this embodiment, predetermined five alteration periods HT0 to HT4 different form one another are added to the basal exposure period RA, by which candidate exposure periods RK0 to RK4 different from one another are generated from the basal exposure period RA. As the frequency level of the spread spectrum clock SS at the timing when the switching signal CS becomes L level is higher, a longer candidate exposure period RK out of the five candidate exposure periods RK0 to RK4 is selected as the exposure period RB for lighting the LED element 37 of the lighting target.

More specifically, as shown in FIG. 8, at the timing when the first switching signal CS having a frequency level of high-frequency side Level 4 becomes L level, the basal exposure period RA (the period during which the basal exposure signal SRA holds at L level) is shorter than the basal exposure periods RA of the other Levels 0 to 3. For this reason, the candidate exposure period RK4 having the longer alteration period HT is selected as the exposure period RB for lighting the LED element 37 of the lighting target. That is, a relatively shorter basal exposure period RA is compensated by a relatively longer alteration period HT4. Similarly, at the timing when the second switching signal CS having a frequency level of Level 2 becomes L level, the candidate exposure period RK2 is selected as the exposure period RB. At the timing when the third switching signal CS having a frequency level of Level 1 becomes L level, the candidate exposure period RK1 is selected as the exposure period RB.

As a result, lengths T1 to T3 of the exposure period RB become generally equal to one another. Consequently, variations in the lengths of the exposure period RB can be suppressed while utilizing the spread spectrum clock SS, as compared with cases where the LED element 37 of the lighting target is lighted with the basal exposure period RA.

Also, since the candidate exposure periods RK0 to RK4 are generated by adding the predetermined alteration periods HT0 to HT4 to the basal exposure period RA, those candidate exposure periods RK0 to RK4 can be generated from the basal exposure period RA and an exposure period RB can be selected from among the generated candidate exposure periods RK0 to RK4 without performing any complex processing such as integration processing.

In the printer 1 of this embodiment, by the use of the output circuit 41 that holds the frequency level outputted to the selector section 50 while the LED element 37 of the lighting target is emitting light, it is possible to suppress changes of the output of the selector section 50 while the LED element 37 is emitting light.

In the printer 1 of this embodiment, it is possible to make up the detector section 49 that detects a frequency level of the spread spectrum clock SS from comparison results between the SS counter value and the thresholds A, C, E, G.

In the printer 1 of this embodiment, it is possible to make up the candidate generator section 43 that generates five candidate exposure periods RK0 to RK4 from the basal exposure period RA by the five candidate generator circuits 43A to 43E.

In the printer 1 of this embodiment, since the candidate generator circuits 43A, 43B, 43D, 43E have the delay circuits 48A, 48B, it is easy to generate the candidate exposure periods RK4, RK3, RK1, RK0 from the basal exposure period RA.

In the printer 1 of this embodiment, it is possible to set alteration periods HT4, HT3, HT1, HT0 corresponding to frequency levels for the candidate generator circuits 43A, 43B, 43D, 43E having the delay circuits 48A, 48B depending on differences in the number of delay elements FF.

In the printer 1 of this embodiment, the specified delay period is shorter than the shortest clock cycle of the spread spectrum clock SS. Therefore, the alteration periods HT0 to HT4 can be set independent of the spread spectrum clock SS. Also, as compared with cases where the alteration periods HT0 to HT4 are set from clock cycles of the spread spectrum clock SS, the alteration periods HT0 to HT4 can be set more finely so that variations of the length of the exposure period RB can be suppressed.

In the printer 1 of this embodiment, by delaying the start timing of the basal exposure period RA by a delay period and by maintaining the end timing of the basal exposure period RA, it is possible to generate the candidate exposure period RK with the basal exposure period RA shortened. Also, by maintaining the start timing of the basal exposure period RA and by delaying the end timing of the basal exposure period RA by a delay period, it is possible to generate the candidate exposure period RK with the basal exposure period RA prolonged.

In the printer 1 of this embodiment, since the alteration period of zero is included in the five alteration periods HT0 to HT4 corresponding to the five candidate generator circuits 43A to 43E, the alteration period of zero can be used as a reference to set the other alteration periods HT0, HT1, HT3, and HT4.

Figure 9:
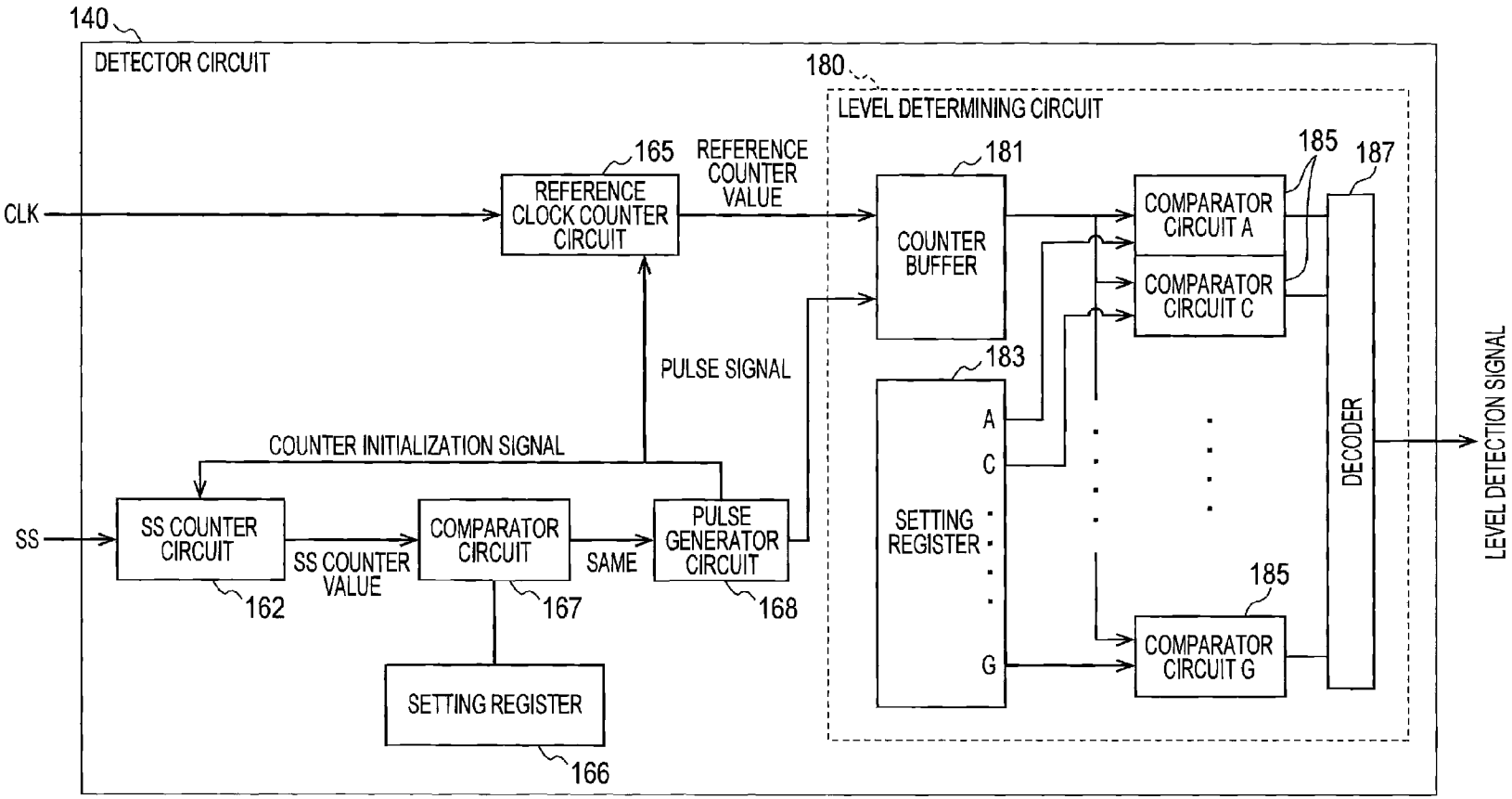
FIG. 9 is a circuit diagram of a detector circuit 140.

FIG. 9 shows another embodiment. This embodiment differs from the above-described embodiment in the configuration of a detection circuit 140 and otherwise is similar to the above-described embodiment. Accordingly, with like reference signs used, overlapping descriptions are omitted between those embodiments, and only the differences will be described below.

In this embodiment, the total number of the clock count during the modulation cycle of the spread spectrum clock SS is divided by sixteen, by which seven thresholds A to G that divides the frequency region into eight are defined. Then, in the detection circuit 140, five frequency levels are set including Level 0 in which the frequency is less than threshold A, Level 1 in which the frequency is equal to or higher than threshold A and lower than threshold C, Level 2 in which the frequency is equal to or higher than threshold C and lower than threshold E, Level 3 in which the frequency is equal to or higher than threshold E and lower than threshold G, and Level 4 in which the frequency is equal to or higher than threshold G.

The detection circuit 140 includes a reference clock counter circuit 165, an SS counter circuit 162, a setting register 166, a comparator circuit 167, a pulse generator circuit 168, and a level determining circuit 180. The reference clock counter circuit 165 is an example of the timer circuit.

The reference clock counter circuit 165 counts the reference counter value that is the clock count of the reference clock CLK inputted from the frequency divider circuit 78. The SS counter circuit 162 counts the SS counter value that is the clock count of the spread spectrum clock SS inputted from the frequency divider circuit 78. The comparator circuit 167 compares an SS counter value counted by the SS counter circuit 162 with a certain second reference clock count stored in the setting register 166. If a comparison result by the comparator circuit 167 is the same, then the pulse generator circuit 168 outputs a pulse signal indicative of the same to the level determining circuit 180. When the comparison result by the comparator circuit 167 is the same, the pulse generator circuit 168 outputs a counter initialization signal to the reference clock counter circuit 165 and the SS counter circuit 62.

In more detail, the pulse generator circuit 168 outputs a pulse signal and a counter initialization signal at every second reference clock count generated by the spread spectrum clock SS. The second reference clock count is set so as to be equal to a divided number ΔN resulting from 16-division of the total clock count during the modulation cycle of the spread spectrum clock SS. Therefore, the pulse generator circuit 168 outputs the pulse signal and the counter initialization signal, every time the divided number ΔN of the spread spectrum clock SS is generated.

The SS counter circuit 162, upon input of the counter initialization signal from the pulse generator circuit 168, initializes the SS counter value. The reference clock counter circuit 165, upon input of the counter initialization signal from the pulse generator circuit 168, outputs a reference counter value to the level determining circuit 180, thereafter initializing the reference counter value.

That is, the reference clock counter circuit 165 counts the clock number of the reference clocks CLK that is generated until the divided number ΔN of spread spectrum clocks SS are generated, and outputs, to the level determining circuit 180, the reference counter value corresponding to a period needed for generating the divided number ΔN of spread spectrum clocks SS.

From the reference counter value counted by the reference clock counter circuit 165, the level determining circuit 180 determines a frequency level of the spread spectrum clock SS in the period needed for generating the divided number ΔN. The level determining circuit 180 includes a counter buffer 181, a setting register 183, four comparator circuits 185, and a decoder 187. The counter buffer 181 holds a reference counter value inputted from the reference clock counter circuit 165 in synchronization with the pulse signal inputted from the pulse generator circuit 168.

Four thresholds A, C, E, G for classification into five frequency levels are stored in the setting register 183. The four thresholds A, C, E, G are set in correspondence to the four comparator circuits 185, respectively, and the comparator circuits 185 compare the reference counter value held in the counter buffer 181 with the corresponding thresholds A, C, E, G, respectively. From the comparison results by the individual comparator circuits 185, the decoder 187 detects a frequency level of the spread spectrum clock SS in the divided number ΔN in which the reference counter value is counted, and then outputs a level detection signal indicative of the detected frequency level to the output circuit 41.

As described above, in the printer 1 of this embodiment, it is possible to make up the detection circuit 140 that detects a frequency level of the spread spectrum clock SS from comparison results between the reference counter value and the thresholds A, C, E, G.

Figure 10:
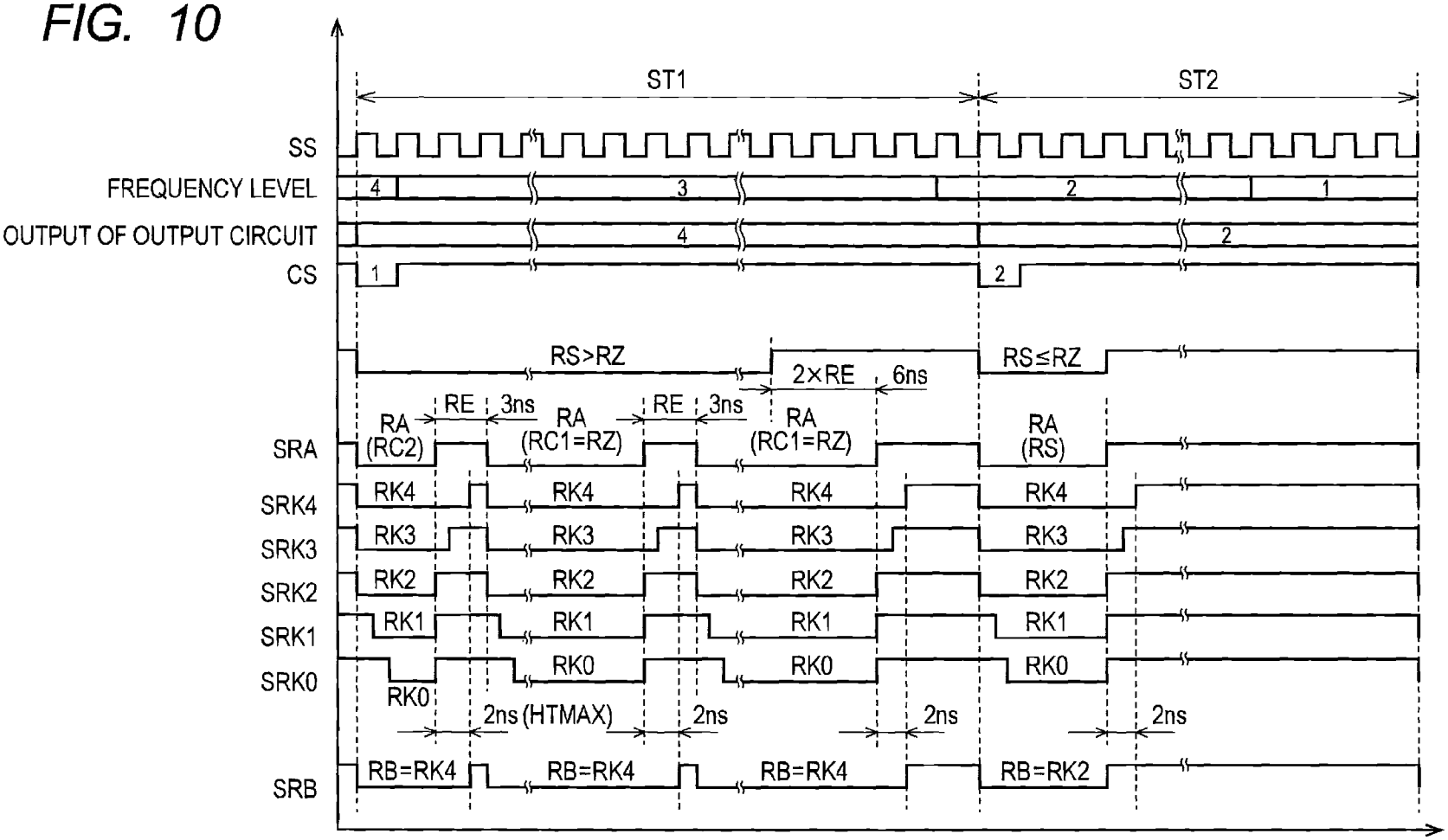
FIG. 10 is a timing chart of a basal exposure period RA and an exposure period RB.

FIG. 10 shows another embodiment. This embodiment differs from the above-described embodiment, except that, when a particular condition is satisfied, a plurality of basal exposure periods RA is set within a selection period ST from the timing at which a switching signal CS becomes L level to the timing at which the switching signal CS becomes L level the next time, and a candidate exposure period RK is generated and selected for each basal exposure period RA. Thus, like parts and components are designated by the same reference numerals as the above-described embodiment to avoid duplicating description.

As shown in FIG. 10, in the present embodiment, in order to set the basal exposure period RA, first, the setting section 42 sets, within the selection period ST, a setting exposure period RS that continues for a period corresponding to a particular clock count of the spread spectrum clock SS from the timing at which the switching signal CS becomes L level. Here, the selection period ST is a period in which an LED element 37 of the lighting target is selected from the plurality of LED elements 37. The setting section 42 converts a tone value of print data corresponding to the LED element 37 of the lighting target (that is, a tone value of pixel identified by print data in association with the LED element 37 of the lighting target) into a clock count of the spread spectrum clock SS corresponding to the setting exposure period RS. And, the setting section 42 performs conversion such that, as the tone value of print data corresponding to the LED element 37 of the lighting target is higher, the clock count of the spread spectrum clock SS becomes greater. Hence, the setting section 42 sets the setting exposure period RS such that, as the tone value of print data is higher, the setting exposure period RS becomes longer. The tone value is an example of density of pixel.

After setting the setting exposure period RS, the setting section 42 compares the setting exposure period RS with a preliminarily determined reference period RZ. When the setting exposure period RS is longer than the reference period RZ, the setting section 42 divides the setting exposure period RS into a plurality of divided exposure periods RC. Here, the reference period RZ is a period corresponding to the reference clock count of the spread spectrum clock SS. The reference clock count is 16, for example.

Specifically, when the setting exposure period RS is longer than the reference period RZ, the setting section 42 divides the setting exposure period RS into: Y (Y is an integer greater than or equal to one) first divided exposure periods RC1 having the same length as the reference period RZ; and a second divided exposure period RC2 that is obtained by subtracting the Y first divided exposure periods RC1 from the setting exposure period RS and that is shorter than the reference period RZ. That is, the setting section 42 divides the setting exposure period RS by a unit of the reference period RZ to set the divided exposure periods RC. Hence, as the setting exposure period RS is longer, the setting section 42 divides the setting exposure period RS into a greater number of divided exposure periods RC. In the example shown in FIG. 10, the setting exposure period RS of a first selection period ST1 is longer than twice of the reference period RZ and is shorter than three times of the reference period RZ. Hence, the setting section 42 divides the setting exposure period RS of the first selection period ST1 into two first divided exposure periods RC1 and one second divided exposure period RC2. The total time period of the divided exposure periods RC1, RC2 is equal to the setting exposure period RS of the first selection period ST1.

The setting section 42 sets each of the plurality of divided exposure periods RC, which has been obtained by dividing the setting exposure period RS, to the basal exposure period RA. Further, the setting section 42 sets an interval period RE between one basal exposure period RA and another basal exposure period RA. In the example shown in FIG. 10, the setting section 42 sets the first basal exposure period RA that continues for the second divided exposure period RC2 from the timing at which the switching signal CS becomes L level. Then, the setting section 42 sets the second basal exposure period RA that continues for the first divided exposure period RC1 from the timing after the interval period RE has elapsed from the end timing of the first basal exposure period RA. Further, the setting section 42 sets the third basal exposure period RA that continues for the first divided exposure period RC1 from the timing after the interval period RE has elapsed from the end timing of the second basal exposure period RA. As a result of this, the end timing of the third basal exposure period RA is delayed from the end timing of the setting exposure period RS by twice of the interval period RE.

The setting section 42 becomes L level at the start timing of each basal exposure period RA, becomes H level at the end timing of each basal exposure period RA, and outputs, to the candidate generator 43, a reference exposure signal SRA that is maintained at H level in the interval period RE. By this operation, the LED element 37 of a lighting target stops light emission in the interval period RE.

The setting section 42 sets the interval period RE such that the interval period RE is equal to or longer than a longest alteration period HTMAX that is the longest one of five alteration periods HT preliminarily set in the candidate generator 43. In the example shown in FIG. 10, the longest alteration period HTMAX is approximately 2 ns, and the interval period RE is set to approximately 3 ns which is longer than 2 ns.

On the other hand, if the setting exposure period RS is shorter than or equal to the reference period RZ, the setting section 42 does not divide the setting exposure period RS. In the example shown in FIG. 10, the setting exposure period RS of the second selection period ST2 is shorter than the reference period RZ. Hence, without dividing the setting exposure period RS of the second selection period ST2, the setting section 42 sets the basal exposure period RA that continues for the same length as the setting exposure period RS from the timing at which the switching signal CS becomes L level.

The candidate generator 43 adds five alteration periods HT to the basal exposure period RA for each basal exposure period RA, thereby generating five candidate exposure periods RK0 to RK4. The selector 50 selects, as the exposure period RB, one candidate exposure period RK from the five candidate exposure periods RK0 to RK4 for each basal exposure period RA.

As described above, the detector 49 acquires the frequency level at the timing when the switching signal CS becomes L level, and keeps the frequency level outputted from the output circuit 41 to the selector 50, that is, output of the output circuit shown in FIG. 10 until the timing at which the switching signal CS becomes L level next time, that is, in the selection period ST. In the example shown in FIG. 10, output of the output circuit is kept at Level 4 in the first selection period ST1. Hence, each of two first basal exposure periods RA1 and one second basal exposure period RA2 included in the first selection period ST1, the candidate exposure period RK4 is selected. Accordingly, in the first selection period ST1, each basal exposure period RA is compensated by the alteration period HT4, and variations of the length of the exposure period RB in the first selection period ST1 is suppressed for a time period of three times the alteration period HT4. As a result of this, the exposure period RB in the first selection period ST1 becomes equal to a certain target period determined by the tone value of corresponding print data.

As described above, in the printer 1 of the present embodiment, when the setting exposure period RS is longer than the reference period RZ, the plurality of basal exposure periods RA is set in the selection period ST, and the candidate exposure period RK is generated and selected for each basal exposure period RA. In the printer 1 of the present embodiment, since the output of the output circuit is kept in the selection period ST, in the plurality of basal exposure periods RA set in the selection period ST, the candidate exposure period RK to which the same alteration period HT has been added is selected. That is, the same alteration period HT is added a plurality of times to the exposure period RB of the selection period ST in which the plurality of basal exposure periods RA is set. Hence, compared with a case in which the setting exposure period RS is not divided, this configuration can increase the total time period of the alteration period HT added to the exposure period RB, and expand a range in which variations of the length of the exposure period RB can be suppressed.

In the printer 1 of the present embodiment, the divided exposure periods RC are set by dividing the setting exposure period RS by a unit of the reference period RZ, and each of the divided exposure periods RC is set to the basal exposure period RA. That is, as the setting exposure period RS is longer, a greater number of basal exposure periods RA is set. Hence, the range can be further expanded in which variations of the length of the exposure period RB can be suppressed. The setting exposure period RS becomes longer as the tone value of print data is higher. Hence, the above-described feature can be rephrased as that, as the tone value of print data is higher, the range can be expanded in which variations of the length of the exposure period RB can be suppressed.

In the printer 1 of the present embodiment, when the setting exposure period RS is shorter than or equal to the reference period RZ, the basal exposure period RA is not divided. Accordingly, when the setting exposure period RS is shorter than or equal to the reference period RZ, a situation can be suppressed in which the setting exposure period RS is divided into the plurality of divided exposure periods RC, and the alteration period HT more than necessary is added to the exposure period RB so that the exposure period RB becomes a period of a length different from a certain target period.

In the printer 1 of the present embodiment, the setting exposure period RS is divided by the unit of the reference period RZ, so that the divided exposure period RC is set. Accordingly, when the length of the setting exposure period RS is the same, the setting exposure period RS is divided into the same number of the divided exposure periods RC, and the same number of the basal exposure periods RA is set. Hence, when the length of the setting exposure period RS is the same, the same number of the alteration periods HT can be added to the exposure period RB. Thus, compared with a case in which a different number of alteration periods is added, it is easier to adjust the exposure period RB to a certain time period.

In the printer 1 of the present embodiment, the interval period RE is set such that the interval period RE is longer than or equal to the longest alteration period HTMAX. For example, when the candidate exposure period RK is generated by delaying the end timing of the basal exposure period RA by the alteration period HT, the end timing of the basal exposure period RA is sometimes delayed by the longest alteration period HTMAX. At this time, if the interval period RE is shorter than the longest alteration period HTMAX, the alteration period HT cannot be added to the basal exposure period RA, and the candidate exposure period RK cannot be generated. In the printer 1 of the present embodiment, the interval period RE is set such that the interval period RE is equal to or longer than the longest alteration period HTMAX. Thus, the candidate exposure period RK for each basal exposure period RA can be generated reliably.

<Modifications>

While the disclosure has been described in detail with reference to the above aspects thereof, it would be apparent to those skilled in the art that various changes and modifications may be made therein without departing from the scope of the claims. In the following description, like parts and components are designated by the same reference numerals to avoid duplicating description.

The above-described embodiments have been described on a direct-transfer tandem type color laser printer as an example of image forming apparatuses. However, the image forming apparatus may be an image forming apparatus of other types such as the intermediate transfer type and the four-cycle type, image forming apparatuses exclusively for monochrome use, printers, copiers, facsimile apparatuses, and multifunction peripherals. The present disclosure is applicable also to these image forming apparatuses.

In the above-described embodiments, a part of entirety of the configuration of FIG. 3 implemented by the device control circuit 79, which is a dedicated hardware circuit, may also be implemented by one or plurality of CPUs and moreover may be fulfilled by both a CPU 71 and a hardware circuit. In such a case, the CPU and the hardware circuit are an example of the controller.

Further, a part or entirety of the configuration of FIG. 3 may be implemented by a CPU of personal computers that communicates with the printer 1. For example, the CPU of a personal computer may detect a frequency level of the spread spectrum clock SS and output a detection result to the selector section 50.

In FIG. 3, the candidate generator circuits 43A to 43E of the candidate generator section 43 may only include a candidate generator circuit having an AND circuit and having a positive alteration period HT and a candidate generator circuit with an alteration period of zero. Or, the candidate generator circuits 43A to 43E may only include a candidate generator circuit having an OR circuit and having a negative alteration period HT and a candidate generator circuit with an alteration period of zero.

In FIG. 3, an example is shown in which the five candidate generator circuits 43A to 43E are included in the candidate generator section 43. However, the number of candidate generator circuits included in the candidate generator section 43 may be changed as required. One candidate generator circuit may use a plurality of alteration periods HT to generate a plurality of candidate exposure periods RK from the basal exposure period RA.

In FIG. 5, an example of the spread spectrum clock SS in which the frequency varies at a constant cycle is shown as the frequency-varying clock. However, clocks with irregularly-varying frequency may also be used. In the printer 1 of the embodiments, since the exposure period RB is generated from the basal exposure period RA by using a frequency level of the spread spectrum clock SS at the timing when the switching signal CS becomes L level, it is possible to suppress variations of the length of the exposure period RB even when the clock frequency varies irregularly, unlike the prior art technique using the spread spectrum clock SS in which the frequency varies at a constant cycle.

Also, the timing at which the frequency level of the spread spectrum clock SS is detected is not limited to the timing at which the switching signal CS becomes L level, and needs only to be within the basal exposure period RA. Further, the number of times the frequency level of the spread spectrum clock SS is detected is not limited to one, and the frequency level may be detected a plurality of times within the basal exposure period RA and, from those detection results, the frequency level of the spread spectrum clock SS may be detected.

FIG. 3 shows an example of the LED elements 37 of the exposure unit 5 in which the LED element 37 of the lighting target is switched sequentially by the switching elements 38. Alternatively, when a plurality of LED elements 37 included in the exposure unit 5 are divided into a plurality of units, the LED elements 37 of the lighting target may be switched sequentially.

Furthermore, the device control circuit 79 may be such that a plurality of switching elements 38 corresponding to the plurality of LED elements 37 are switched simultaneously so that a plurality of LED elements 37 simultaneously emits light. In this case, too, from among a plurality of candidate exposure periods RK generated from the basal exposure period RA that is determined by the clock count of the spread spectrum clock SS, an exposure period RB for lighting a plurality of LED elements 37 simultaneously may be set depending on the frequency level of the spread spectrum clock SS.

In FIG. 10, the example is shown in which the setting exposure period RS of the first selection period ST1 is divided into the two first divided exposure periods RC1 and one second divided exposure period RC2. However, the setting exposure period RS is not necessarily divided into the first divided exposure period RC1 and the second divided exposure period RC2. For example, when the setting exposure period RS is equal to twice of the reference period RZ, the setting exposure period RS is divided into two first divided exposure periods RC1. In this case, it can be said that the setting section 42 divides the setting exposure period RS into the two first divided exposure periods RC1 and zero (0) second divided exposure period RC2.

What is claimed is:

1. An exposure device comprising:

a plurality of light emitting elements arranged in a main scanning direction;

a setter configured to set a basal exposure period of the plurality of light emitting elements, based on a clock count of frequency-spread clocks;

a candidate generator configured to add, to the basal exposure period, predetermined N alteration periods (N is an integer greater than or equal to two) having different lengths from each other, thereby generating N candidate exposure periods having different lengths from each other;

a detector configured to detect a frequency level of the clocks in a period corresponding to the basal exposure period; and a selector configured to select, as an exposure period for lighting the plurality of light emitting elements, a longer one of the N candidate exposure periods as the frequency level detected by the detector is higher.

2. The exposure device according to claim 1, wherein the detector comprises:

a detector circuit configured to detect the frequency level of the clocks at each particular period; and an output circuit configured to output a detection result of the detector circuit to the selector, and to keep the detection result outputted to the selector during a period in which the plurality of light emitting elements emits light.

3. The exposure device according to claim 2, wherein the setter is configured, in a selection period in which a light emitting element of a lighting target is selected from the plurality of light emitting elements, to set a setting exposure period based on a clock count of the clocks and to set, as the basal exposure period, each of a plurality of divided exposure periods obtained by dividing the setting exposure period;

wherein the output circuit is configured to keep the detection result outputted to the selector in the selection period;

wherein the candidate generator is configured to generate the N candidate exposure periods for each basal exposure period; and wherein the selector is configured to select the exposure period for each basal exposure period.

4. The exposure device according to claim 3, wherein the setter is configured to divide the setting exposure period into a greater number of the divided exposure periods as the setting exposure period is longer.

5. The exposure device according to claim 4, further comprising a memory, wherein, as density of a pixel identified by image data stored in the memory is higher, the setter is configured to set the setting exposure period corresponding to the pixel to a longer period.

6. The exposure device according to claim 3, wherein the setter is configured to:

divide the setting exposure period into the plurality of divided exposure periods when the setting exposure period is longer than a reference period; and not divide the setting exposure period when the setting exposure period is shorter than or equal to the reference period.

7. The exposure device according to claim 6, wherein the setter is configured to, when the setting exposure period is longer than the reference period, divide the setting exposure period into: Y (Y is an integer greater than or equal to one) first divided exposure periods having a same length as the reference period; and a second divided exposure period that is obtained by subtracting the Y first divided exposure periods from the setting exposure period and that is shorter than the reference period.

8. The exposure device according to claim 3, wherein the setter is configured to set an interval period between one basal exposure period and another basal exposure period in a plurality of basal exposure periods set from the same setting exposure period, the interval period being for stopping light emission of the plurality of light emitting elements; and wherein the interval period is equal to or longer than a longest one of the N alteration periods.

9. The exposure device according to claim 1, wherein the detector comprises:

a counter circuit configured to count a clock count of the clocks in a certain period; and a comparator circuit configured to compare the clock count counted by the counter circuit with at least N−1 thresholds that are preliminarily set in association with the N frequency levels; and wherein the detector is configured to detect which one of the N frequency levels a frequency of the clocks corresponds to, based on a comparison result of the comparator circuit.

10. The exposure device according to claim 1, wherein the detector comprises:

a timer circuit configured to measure a length of a period needed for generating the clocks of a certain clock count; and a comparator circuit configured to compare the length of the period measured by the timer circuit with at least N−1 thresholds that are preliminarily set in association with the N frequency levels; and wherein the detector is configured to detect which one of the N frequency levels a frequency of the clocks corresponds to, based on a comparison result of the comparator circuit.

11. The exposure device according to claim 1, wherein the candidate generator comprises N candidate generator circuits configured to generate, from the basal exposure period, respective ones of N candidate exposure periods having different lengths from each other.

12. The exposure device according to claim 11, wherein at least one of the N candidate generator circuits comprises a delay circuit configured to delay the basal exposure period by a delay period equal to an absolute value of one of the alteration periods to obtain a delay exposure period; and wherein the at least one of the N candidate generator circuits is configured to perform at least one of: changing start timing of the basal exposure period to start timing of the delay exposure period; and changing end timing of the basal exposure period to end timing of the delay exposure period, thereby generating the candidate exposure period from the basal exposure period.

13. The exposure device according to claim 12, wherein at least two of the N candidate generator circuits have the delay circuit;

wherein each delay circuit has at least one delay element for delaying an input signal by a particular delay period; and wherein a number of the at least one delay element included in each delay circuit differs depending on the frequency level corresponding to the alteration period set in the candidate generator circuit including the delay circuit.

14. The exposure device according to claim 13, wherein the particular delay period is shorter than a shortest clock cycle of the clocks.

15. The exposure device according to claim 12, wherein at least one of the N candidate generator circuits is configured to delay the start timing of the basal exposure period by the delay period and to maintain the end timing of the basal exposure period, thereby generating the candidate exposure period from the basal exposure period.

16. The exposure device according to claim 12, wherein at least one of the N candidate generator circuits is configured to maintain the start timing of the basal exposure period and to delay the end timing of the basal exposure period by the delay period, thereby generating the candidate exposure period from the basal exposure period.

17. The exposure device according to claim 1, wherein the alteration period includes an alteration period of zero (0).

18. An image forming apparatus comprising:

a photosensitive member;

a plurality of light emitting elements arranged in a rotational axis direction of the photosensitive member;

a setter configured to set a basal exposure period of the plurality of light emitting elements, based on a clock count of frequency-spread clocks;

a candidate generator configured to add, to the basal exposure period, predetermined N alteration periods (N is an integer greater than or equal to two) having different lengths from each other, thereby generating N candidate exposure periods having different lengths from each other;

a detector configured to detect a frequency level of the clocks in a period corresponding to the basal exposure period; and a selector configured to select a longer one of the N candidate exposure periods as the frequency level detected by the detector is higher, wherein the plurality of light emitting elements is configured to expose the photosensitive member during the candidate exposure period.

19. A method of controlling an exposure device including a plurality of light emitting elements arranged in a main scanning direction, the method comprising:

setting a basal exposure period of the plurality of light emitting elements, based on a clock count of frequency-spread clocks;

adding, to the basal exposure period, predetermined N alteration periods (N is an integer greater than or equal to two) having different lengths from each other, thereby generating N candidate exposure periods having different lengths from each other;

detecting a frequency level of the clocks in a period corresponding to the basal exposure period; and selecting, as an exposure period for lighting the plurality of light emitting elements, a longer one of the N candidate exposure periods as the frequency level is higher.

* * * * *